US005256620A

United States Patent [19]

Burberry et al.

[11] Patent Number: 5,256,620

[45] Date of Patent: Oct. 26, 1993

[54] IR ABSORBER FOR LASER-INDUCED THERMAL DYE TRANSFER

[75] Inventors: Mitchell S. Burberry, Webster; Lee W. Tutt; Michael R. Detty, both of Rochester, all of N.Y.

[73] Assignee: Eastman Kodak Company, Rochester, N.Y.

[21] Appl. No.: 992,233

[22] Filed: Dec. 17, 1992

[51] Int. Cl.[5] ..... B41M 5/035; B41M 5/38

[52] U.S. Cl. ..... 503/227; 428/195; 428/913; 428/914; 430/200; 430/201; 430/945

[58] Field of Search ..... 8/471; 428/195, 913, 428/914; 503/227; 430/200, 201, 945

[56] References Cited

U.S. PATENT DOCUMENTS

| | | | |
|---|---|---|---|
| 4,942,141 | 7/1990 | DeBoer et al. | 503/227 |
| 5,019,549 | 5/1991 | Kellogg et al. | 503/227 |
| 5,153,169 | 10/1992 | Freedman et al. | 503/209 |

*Primary Examiner*—B. Hamilton Hess
*Attorney, Agent, or Firm*—Harold E. Cole

[57] ABSTRACT

This invention relates to a dye donor element for laser-induced thermal dye transfer comprising a support having thereon a dye layer comprising an image dye in a binder and an infrared-absorbing material associated therewith, and wherein the infrared-absorbing material is a telluro- or seleno-squarylium dye having the following formula:

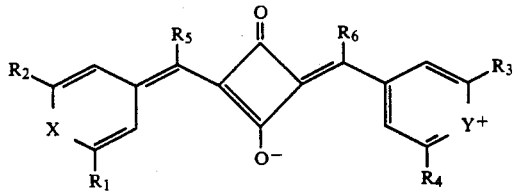

wherein:

$R_1$, $R_2$, $R_3$ and $R_4$ each independently represents hydrogen or a substituted or unsubstituted alkyl, aryl or hetaryl group;

$R_5$ and $R_6$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl or hetaryl group;

X represents Se or Te; and

Y represents O, S, Se, Te, $TeCl_2$ or $TeBr_2$, with the proviso that when X and Y are both Se and $R_1$, $R_2$, $R_3$ and $R_4$ each represents t-butyl, then $R_5$ and $R_6$ cannot both be hydrogen at the same time; and with the second proviso that when X is Se and Y is O and $R_1$, $R_2$, $R_3$ and $R_4$ each represents t-butyl, then $R_5$ and $R_6$ cannot both be hydrogen at the same time.

18 Claims, No Drawings

IR ABSORBER FOR LASER-INDUCED THERMAL DYE TRANSFER

This invention relates to the use of certain infrared-absorbing materials in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

U.S. Pat. Nos. 4,942,141 and 5,019,549 disclose certain squarylium infrared-absorbing dyes for a laser-induced thermal dye transfer system. While these dyes are useful for the intended purpose, there is a need for additional infrared-absorbing materials with narrow absorption bands at other, selected wavelengths and exhibiting different solvent and film compatibilities.

U.S. Pat. No. 5,153,169 discloses imaging media containing hindered amine light stabilizers or nitrones. While these imaging media do not contain dyes for transferring to another support by the action of a laser, the reference does disclose the use of certain IR dyes similar to those described herein. However, as will be shown by comparative tests hereafter, the wavelengths of these dyes only extend to about 870 nm. It would be desirable to provide compounds with longer or shorter wavelengths in order to obtain improved color separation in a thermal dye transfer system.

It is an object of this invention to provide an infrared-absorbing material which has a narrow absorption band at selected wavelengths and which exhibits solvent and film compatibilities different from those of the prior art.

These and other objects are achieved in accordance with this invention which relates to a dye donor element for laser-induced thermal dye transfer comprising a support having thereon a dye layer comprising an image dye in a binder and an infrared-absorbing material associated therewith, and wherein the infrared-absorbing material is a telluro- or seleno-squarylium dye having the following formula:

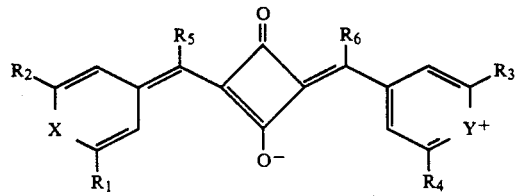

wherein:

$R_1$, $R_2$, $R_3$ and $R_4$ each independently represents hydrogen or a substituted or unsubstituted alkyl, aryl or hetaryl group;

$R_5$ and $R_6$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl or hetaryl group;

X represents Se or Te; and

Y represents O, S, Se, Te, $TeCl_2$ or $TeBr_2$, with the proviso that when X and Y are both Se and $R_1$, $R_2$, $R_3$ and $R_4$ each represents t-butyl, then $R_5$ and $R_6$ cannot both be hydrogen at the same time; and with the second proviso that when X is Se and Y is O and $R_1$, $R_2$, $R_3$ and $R_4$ each represents t-butyl, then $R_5$ and $R_6$ cannot both be hydrogen at the same time.

In a preferred embodiment of the invention, $R_1$, $R_2$, $R_3$ and $R_4$ are each tert-butyl, $R_5$ and $R_6$ are each hydrogen, and X and Y are both Te. In another preferred embodiment, $R_1$, $R_2$, $R_3$ and $R_4$ are each tertbutyl, $R_5$ and $R_6$ are each hydrogen, X is Te and Y is $TeBr_2$. In still another preferred embodiment, $R_1$, $R_2$, $R_3$ and $R_4$ are each phenyl, $R_5$ and $R_6$ are each hydrogen, X is Se and Y is Te or Se. In still yet another preferred embodiment, $R_1$, $R_2$, $R_3$ and $R_4$ are each tertbutyl, $R_5$ and $R_6$ are each methyl, and X and Y are both Se or both Te.

The above infrared-absorbing dyes may be employed in any concentration which is effective for the intended purpose. In general, good results have been obtained at a concentration from about 0.05 to about 0.5 $g/m^2$ within the dye layer itself or in an adjacent layer. In a preferred embodiment, the infrared-absorbing dye is located in the dye layer along with the image dye, which is a dye different from the infrared-absorbing dye.

Examples of infrared-absorbing telluro- or seleno-squarylium dyes useful in the invention include the following:

| Dye No. | X | Y | $R_1$ | $R_2$ | $R_3$ | $R_4$ | $R_5$ | $R_6$ |
|---|---|---|---|---|---|---|---|---|
| 1 | Te | Te | t-Bu | t-Bu | t-Bu | t-Bu | Me | Me |
| 2 | Te | Te | t-Bu | t-Bu | t-Bu | t-Bu | H | H |
| 3 | Se | Te | Ph | Ph | Ph | Ph | H | H |
| 4 | Se | Se | t-Bu | t-Bu | t-Bu | t-Bu | Me | Me |
| 5 | Te | $TeBr_2$ | t-Bu | t-Bu | t-Bu | t-Bu | H | H |
| 6 | Se | Se | Ph | Ph | Ph | Ph | H | H |
| 7 | Se | S | t-Bu | t-Bu | t-Bu | t-Bu | H | H |
| 8 | Se | Se | Ph | Ph | Et | Et | H | H |
| 9 | Te | O | Me | Me | Me | Me | H | H |
| 10 | Te | $TeCl_2$ | Me | Me | Me | Me | Cl | Cl |
| 11 | Se | $TeCl_2$ | Me | Me | t-Bu | t-Bu | H | H |
| 12 | Te | S | Me | Me | Ph | Ph | EtO | EtO |
| 13 | Se | Se | Et | Et | Et | Et | Br | Br |
| 14 | Te | Te | Et | Et | Et | Et | CN | CN |
| 15 | Te | O | Et | Et | Ph | Ph | Et | Et |
| 16 | Te | $TeCl_2$ | Hexyl | Hexyl | Naphthyl | Naphthyl | Me | Me |
| 17 | Se | $TeCl_2$ | t-Bu | t-Bu | Me | Me | CN | Br |
| 18 | Te | S | $Br(CH_2)_2$ | $Br(CH_2)_2$ | $Br(CH_2)_2$ | $Br(CH_2)_2$ | i-Pr | i-Pr |
| 19 | Se | Se | H | H | H | H | H | H |
| 20 | Te | Te | Ph | Ph | Ph | Ph | Me | Me |

Me = methyl, Et = ethyl, i-Pr = isopropyl, t-Bu = tert-butyl, Ph = phenyl

Spacer beads may be employed in a separate layer over the dye layer in order to separate the dye-donor from the dye-receiver thereby increasing the uniformity and density of dye transfer. That invention is more fully described in U.S. Pat. No. 4,772,582. The spacer beads may be coated with a polymeric binder if desired.

To obtain the laser-induced thermal dye transfer image employed in the invention, a diode laser is preferably employed since it offers substantial advantages in terms of its small size, low cost, stability, reliability, ruggedness, and ease of modulation. By using the infrared-absorbing material, the laser radiation is absorbed into the dye laser and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

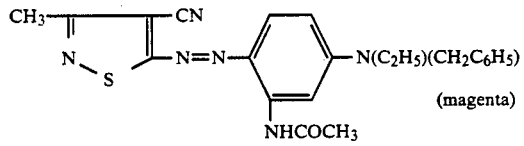

(magenta)

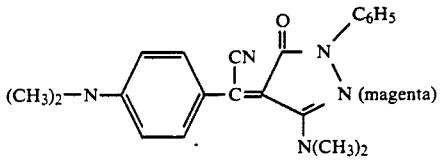

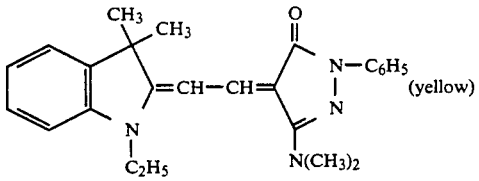

(yellow)

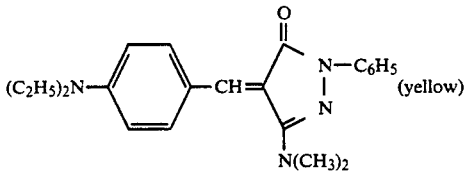

(yellow)

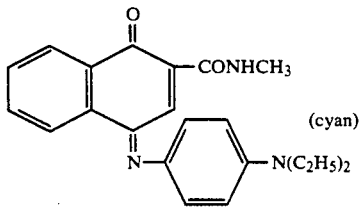

(cyan)

-continued

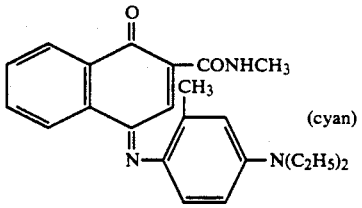

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The image dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone), a poly(phenylene oxide) or a hydrophilic binder such as polyvinyl alcohol or gelatin. The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek®. In a preferred embodiment, an injection-molded polycarbonate support is employed.

The dye image-receiving layer may comprise, for example, a polycarbonate, a polyester, cellulose esters, poly(styrene-co-acrylonitrile), poly-caprolactone or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element as described above with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the laser. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

Preparation of Dye 1

A mixture of 3.44 g (7.00 mmol) of 4-ethyl-2,6-di-tert-butyltellurapyrylium hexafluorophosphate, 1.30 g (11.4 mmol) of squaric acid, and 0.87 g (11 mmole) of pyridine was heated in 75 mL of ethanol at reflux for three hours. The reaction mixture was cooled to ambient temperature and was diluted with 75 mL of water. The copper-bronze mixture was collected by filtration and then washed with water and ether. The crude dye was slurried in boiling acetonitrile and collected by filtration to give 1.53 g (59%) of Dye 1, mp 251°-253° C.: $\lambda_{max}$ ($CH_2Cl_2$) 965 nm ($\epsilon$ 240,000), $^1H$ NMR ($CDCl_3$) $\delta$ 8.51 (s, 4 H), 2.02 (s, 6 H), 1.68 (s, 36 H). Anal. Calcd. for $C_{34}H_{46}O_2Te_2$: C, 55.04; H, 6.20. Found: C, 55.39; H, 6.17.

Preparation of Dye 2

A mixture of squaric acid (0.114 g, 1.00 mmol) and 4-methyl-2,6-di-tert-butyltellurapyrylium tetrafluoroborate (0.814 g, 2.00 mmol) in 20 mL of ethanol was heated at reflux. A solution of diisopropylethylamine (0.258 g, 2.00 mmol) in 5 mL of ethanol was added dropwise. The resulting solution was heated at reflux for 3 hours. The reaction mixture was concentrated in vacuo and the residue was purified via chromatography on silica gel eluted with a mixture of 2% ethanol, 20% ethyl acetate, 78% dichloromethane. The crude product was slurried in ether, filtered, and dried to give 0.233 g (33%) of Dye 2 as bright red crystals, mp 244.5°-245° C.: $\lambda_{max}$ ($CH_2Cl_2$) 910 nm ($\epsilon$ 350,000), $^1H$ NMR ($CDCl_3$) $\delta$ 9.13 (s, 2 H), 7.00 (s, 2 H), 6.36 (s, 2 H), 1.44 (s, 18 H), 1.30 (s, 18 H). Anal. Calcd. for $C_{32}H_{42}O_2Te_2$: C, 53.84; H, 5.93. Found: C, 54.00; H, 6.08.

Preparation of Dye 3

A mixture of squaric acid (1.14 g, 10.0 mmol) and 4-methyl-2,6-di-phenylselenapyrylium hexafluorophosphate (0.455 g, 1.00 mmol) in 50 mL of ethanol was heated at reflux. A solution of pyridine (0.16 g, 2.00 mmol) in 5 mL of ethanol was added dropwise. The resulting solution was heated at reflux for 3 hours. The reaction mixture was concentrated in vacuo and the residue was partitioned between 100 mL of water and 100 mL of dichloromethane. The crude product was redissolved in 20 mL of ethanol and 4-methyl-2,6di-phenyltellurapyrylium trifluoromethanesulfonate (0.50 g, 1.0 mmol) was added. To this solution was added 0.1 g of pyridine and the resulting solution was heated at reflux for 1 hour. The reaction mixture was concentrated in vacuo and the residue was purified via chromatography on silica gel eluted with a mixture of 2% ethanol, 20% ethyl acetate, 78% dichloromethane to give 0.025 g (3%) of Dye 3, mp 203°-208° C.: $\lambda_{max}$ ($CH_2Cl_2$) 930 nm.

Preparation of Dye 4

A mixture of 4-ethyl-2,6-di-tert-butylselenapyrylium hexafluorophosphate (3.03 g, 7.08 mmol), squaric acid (1.30 g, 11.4 mmol), and pyridine (0.87 g, 11 mmol) in 75 mL of ethanol was heated at reflux for 3 hours. The reaction mixture was cooled to ambient temperature and was diluted with 75 mL of water. The copper-bronze colored solid was collected by filtration and then washed with water and ether. The crude dye was slurried in boiling acetonitrile and collected by filtration to give 1.33 g (58%) of Dye 4, mp 254°-255° C.: $\lambda_{max}$ $CH_2Cl_2$) 906 nm ($\epsilon$ 240,000), $^1H$ NMR ($CDCl_3$) $\epsilon$ 8.54 (s, 4 H), 2.04 (s, 6 H), 1.68 (s, 36 H). Anal. Calcd. for $C_{34}H_{46}O_2Se_2$: C, 63.35; H, 7.19. Found: C, 63.39; H, 7.17.

Preparation of Dye 5

Dye 2 (0.038 g, 0.053 mmol) was dissolved in 10 mL of dichloromethane. To this solution was added 1.0 mL (0.06 mmol) of a 10.0 g/L solution of bromine in carbon tetrachloride. The red solution turned an emerald green upon bromine addition. The reaction mixture was concentrated to give a green powder mp 182°-190° C. (dec): $\lambda_{max}$ ($CH_2Cl_2$) 791 nm ($\epsilon$ 120,000), $^1H$ NMR ($CDCl_3$) $\delta$ 8.05 (br s, 1 H), 7.63 (br s, 1 H), 7.33 (br s, 2 H), 6.69 (br s, 1 H), 6.31 (br s, 1 H), 1.60 (br s, 9 H), 1.56 (br s, 18 H), 1.44 (br s, 9 H) [spectrum broadened due to tellurium-bromine exchange].

Preparation of Dye 6

A mixture of squaric acid (0.114 g, 1.00 mmol) and 4-methyl-2,6-di-phenylselenapyrylium hexafluorophosphate (0.455 g, 1.00 mmol) in 50 mL of ethanol was heated at reflux. A solution of pyridine (0.16 g, 2.00 mmol) in 5 mL of ethanol was added dropwise. The resulting solution was heated at reflux for 3 hours. The reaction mixture was concentrated in vacuo and the residue was partitioned between 100 mL of water and 100 mL of dichloromethane. The organic phase was separated, dried over sodium sulfate, and concentrated. The residue was purified via chromatography on silica gel eluted with a mixture of ethanol, 20% ethyl acetate, 78% dichloromethane to give 0.022 g (7%) of Dye 6 as a green solid, mp 239-254: $\lambda_{max}$ ($CH_2Cl_2$) 850 nm ($\epsilon$ 240,000), $^1H$ NMR ($CDCl_3$) $\delta$ 8.10 (s, 4 H), 7.5-7.8 (m, 20 H), 6.93 (s, 2 H).

EXAMPLE 1

A magenta dye-donor according to the invention was prepared by coating an unsubbed 100 $\mu$m thick poly(ethylene terephthalate) support with a layer comprising the first magenta dye illustrated above (0.44 g/m$^2$) and the infrared-absorbing dye as indicated in the Table below (0.16 g/m$^2$) in a cellulose acetate propionate binder (2.5% acetyl, 45% propionyl) (0.31 g/m$^2$) coated from methylene chloride.

A control dye-donor element was made as above containing only the magenta imaging dye and no infrared-absorbing dye. Other comparison dye-donor elements were prepared as described above but containing the following infrared-absorbing dyes:

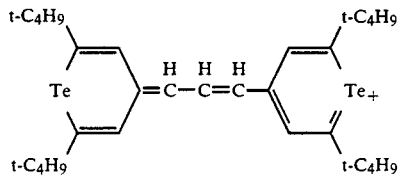

Comparison 1 (a bis(chalcogenopyrylo)polymethine dye as disclosed in U.S. Pat. No. 4,948,777)

-continued

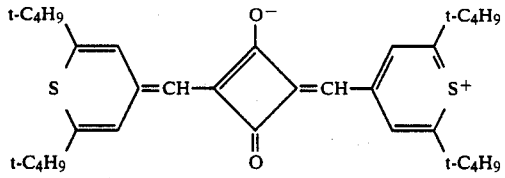

Comparison 2 (U.S. Pat. No. 5,019,549)

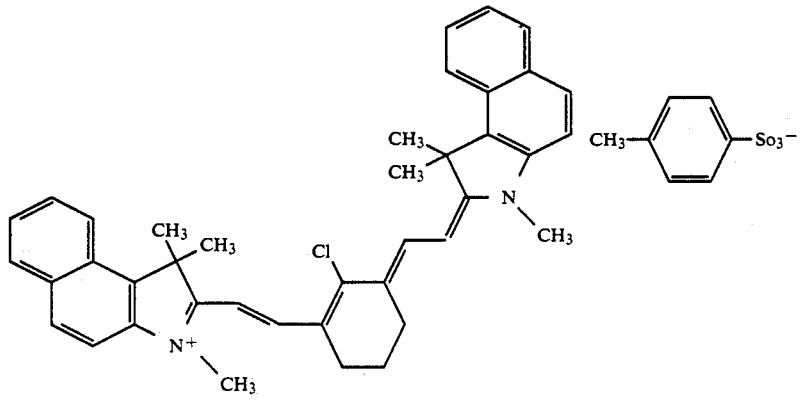

Comparison 3 (a cyanine dye as disclosed in U.S. Pat. No. 4,973,572)

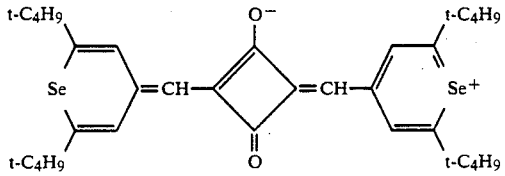

Comparison 4 (a squarylium dye as disclosed in U.S. Pat. No. 5,153,169)

Patches were printed on a resin-coated paper support subbed with 0.22 g/m$^2$ acrylonitrile-vinylidene chloride-acrylic acid (14:80:6) copolymer and coated with 220 g/m$^2$ of Butvar 76® vinyl acetal polymer (Monsanto Co.) The dye-receiver was overlaid with the dye-donor placed on a drum with a circumference of 40 cm and taped with just sufficient tension to be able to see the information of the surface of the dye-donor by reflected light. The assembly was exposed, with the drum rotating at 300 rev/min, to a focused 784.3 nm laser beam from a Hitachi model HL7851G laser using a 7.8×9.9 micrometer elliptical spot (1/e$^2$) diameter and a power of 29.9 milliwatt at the medium. The exposure energy, excluding overlap, was 0.19 Joules/cm$^2$. Then the assembly was exposed, with the drum rotating at 150 rev/min, to a focused 873 nm laser beam from a Sanyo model SDL-6033-101 laser using a 10.3 ×8.6 micrometer elliptical spot (1/e$^2$) diameter and a power of 17.2 milliwatt at the medium. The exposure energy, excluding overlap, was 0.17 Joules/cm$^2$.

The assembly was exposed once more, with the drum rotating at 126 rev/min, to a focused 980.8 nm laser beam from a Sarnoff model CD-299R laser using a 17.9×18.1 micrometer elliptical spot (1/e$^2$) diameter and a power of 23.4 milliwatt at the medium. The exposure energy, excluding overlap, was 0.16 Joules/cm$^2$. The spacing between lines was 10 μm. The total area of dye transfer to the receiver was 6×10 μm. All transferred dye patches were fused in acetone-saturated air at room temperature for 7 min. The Status A green reflection density of each transferred dye area is shown in the Table.

TABLE

| IR Dye in Donor | IR Dye λmax (nm) in CAP[a] | Film o.d. @ λmax | Status A Green Density Transferred to Receiver @ 784 nm | @ 873 nm | @ 981 nm |
|---|---|---|---|---|---|
| none (control) | — | 0.00 | 0.00 | 0.00 | 0.00 |
| Comparison C-1 | 843 | 1.85 | 0.97 | 0.95 | 0.00 |
| Comparison C-2 | 833 | 2.99 | 1.12 | 1.01 | 0.00 |
| Comparison C-3 | 841 | 2.34 | 0.93 | 0.95 | 0.00 |
| Comparison C-4 | 867 | 2.64 | 1.00 | 1.00 | 0.00 |
| Dye 2 | 937 | 2.46 | 0.61 | 0.98 | 0.90 |
| Dye 3 & Dye 6[b] | 982 & 861 | 0.05 & 0.06 | 0.04 | 0.02 | 0.02 |
| Dye 4 | 927 | 2.03 | 0.81 | 1.06 | 0.83 |

TABLE-continued

| IR Dye in Donor | IR Dye $\lambda$max (nm) in CAP[a] | Film o.d. @ $\lambda$max | Status A Green Density Transferred to Receiver @ 784 nm | @ 873 nm | @ 981 nm |
|---|---|---|---|---|---|
| Dye 5 | 792[c] | 0.44 | 0.70 | 0.58 | 0.00 |

[a]CAP cellulose acetate propionate (2.5% acetyl, 45% propionyl)
[b]coating weights of Dye 3 and Dye 6 and each 0.002 g/m$^2$
[c]relatively broad absorption band The above results indicate that all coatings containing an infrared-absorbing dye of the invention gave measurable density at some laser wavelengths, while affording a broader selection of absorption peaks than would be obtainable from the comparison dyes alone. The mixture containing Dye 3 and Dye 6 exhibited relatively weak absorption bands at 982 nm and 861 nm. The low absorption is due to the low concentration of each individual component. Nevertheless, the film showed concomitant activity at the appropriate wavelengths.

Dyes 2, 3, 4 and 6 which show longer wavelengths of absorption than the comparison dyes also give transferred density at 981 nm which is not observed with the comparison dyes. Dye 5 has a $\lambda_{max}$ at 792 nm which is shorter than all the comparison dyes, thus extending the useful range of available diode laser wavelengths.

The invention has been described in detail with particular reference to preferred embodiments thereof, but it will be understood that variations and modifications can be effected within the spirit and scope of the invention.

What is claimed is:

1. In a dye donor element for laser-induced thermal dye transfer comprising a support having thereon a dye layer comprising an image dye in a binder and an infrared-absorbing material associated therewith, the improvement wherein said infrared-absorbing material is a telluro- or seleno-squarylium dye having the following formula:

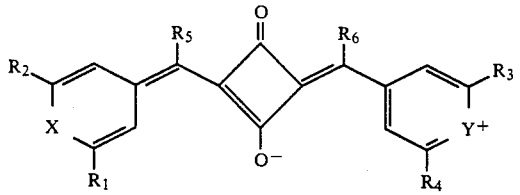

wherein:

$R_1$, $R_2$, $R_3$ and $R_4$ each independently represents hydrogen or a substituted or unsubstituted alkyl, aryl or hetaryl group;

$R_5$ and $R_6$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl or hetaryl group;

X represents Se or Te; and

Y represents O, S, Se, Te, $TeCl_2$ or $TeBr_2$, with the proviso that when X and Y are both Se and $R_1$, $R_2$, $R_3$ and $R_4$ each represents t-butyl, then $R_5$ and $R_6$ cannot both be hydrogen at the same time; and with the second proviso that when X is Se and Y is O and $R_1$, $R_2$, $R_3$ and $R_4$ each represents t-butyl, then $R_5$ and $R_6$ cannot both be hydrogen at the same time.

2. The element of claim 1 wherein $R_1$, $R_2$, $R_3$ and $R_4$ are each tert-butyl, $R_5$ and $R_6$ are each hydrogen, and X and Y are both Te.

3. The element of claim 1 wherein $R_1$, $R_2$, $R_3$ and $R_4$ are each tert-butyl, $R_5$ and $R_6$ are each hydrogen, X is Te and Y is TeBr2.

4. The element of claim 1 wherein $R_1$, $R_2$, $R_3$ and $R_4$ are each phenyl, $R_5$ and $R_6$ are each hydrogen, X is Se and Y is Te or Se.

5. The element of claim 1 wherein $R_1$, $R_2$, $R_3$ and $R_4$ are each tert-butyl, $R_5$ and $R_6$ are each methyl, and X and Y are both Se or both Te.

6. The element of claim 1 wherein said infrared-absorbing material is in said dye layer.

7. In a process of forming a laser-induced thermal dye transfer image comprising:

a) contacting at least one dye-donor element comprising a support having thereon a dye layer comprising an image dye in a binder having an infrared-absorbing material associated therewith, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvement wherein said infrared-absorbing material is a telluro- or seleno-squarylium dye having the following formula:

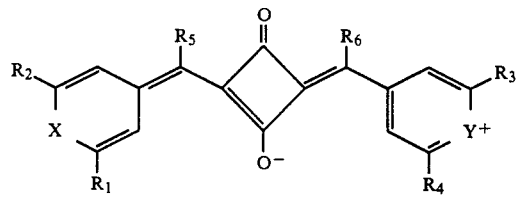

wherein:

$R_1$, $R_2$, $R_3$ and $R_4$ each independently represents hydrogen or a substituted or unsubstituted alkyl, aryl or hetaryl group;

$R_5$ and $R_6$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl or hetaryl group;

X represents Se or Te; and

Y represents O, S, Se, Te, $TeCl_2$ or $TeBr_2$, with the proviso that when X and Y are both Se and $R_1$, $R_2$, $R_3$ and $R_4$ each represents t-butyl, then $R_5$ and $R_6$ cannot both be hydrogen at the same time; and with the second proviso that when X is Se and Y is O and $R_1$, $R_2$, $R_3$ and $R_4$ each represents t-butyl, then $R_5$ and $R_6$ cannot both be hydrogen at the same time.

8. The process of claim 7 wherein $R_1$, $R_2$, $R_3$ and $R_4$ are each tert-butyl, $R_5$ and $R_6$ are each hydrogen, and X and Y are both Te.

9. The process of claim 7 wherein $R_1$, $R_2$, $R_3$ and $R_4$ are each tert-butyl, $R_5$ and $R_6$ are each hydrogen, X is Te and Y is TeBr2.

10. The process of claim 7 wherein $R_1$, $R_2$, $R_3$ and $R_4$ are each phenyl, $R_5$ and $R_6$ are each hydrogen, X is Se and Y is Te or Se.

11. The process of claim 7 wherein $R_1$, $R_2$, $R_3$ and $R_4$ are each tert-butyl, $R_5$ and $R_6$ are each methyl, and X and Y are both Se or both Te.

12. The process of claim 7 wherein said infrared-absorbing material is in said dye layer.

13. In a thermal dye transfer assemblage comprising: p1 (a) a dye donor element comprising a support having thereon a dye layer comprising a dye dispersed in a binder having an infrared-absorbing material associated therewith, and (b) a dye-receiving element comprising a support having thereon a dye image-receiving layer, said dye-receiving element being in superposed relationship with said dye-donor element so that said dye layer is in contact with said dye image-receiving layer, the improvement wherein said infrared-absorbing material is a telluro- or seleno-squarylium dye having the following formula:

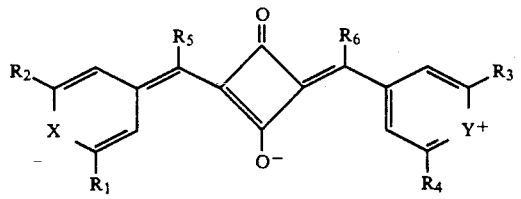

wherein:

$R_1$, $R_2$, $R_3$ and $R_4$ each independently represents hydrogen or a substituted or unsubstituted alkyl, aryl or hetaryl group;

$R_5$ and $R_6$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl or hetaryl group;

X represents Se or Te; and

Y represents O, S, Se, Te, $TeCl_2$ or $TeBr_2$, with the proviso that when X and Y are both Se and $R_1$, $R_2$, $R_3$ and $R_4$ each represents t-butyl, then $R_5$ and $R_6$ cannot both be hydrogen at the same time; and with the second proviso that when X is Se and Y is O and $R_1$, $R_2$, $R_3$ and $R_4$ each represents t-butyl, then $R_5$ and $R_6$ cannot both be hydrogen at the same time.

14. The assemblage of claim 13 wherein $R_1$, $R_2$, $R_3$ and $R_4$ are each tert-butyl, $R_5$ and $R_6$ are each hydrogen, and X and Y are both Te.

15. The assemblage of claim 13 wherein $R_1$, $R_2$, $R_3$ and $R_4$ are each tert-butyl, $R_5$ and $R_6$ are each hydrogen, X is Te and Y is TeBr2.

16. The assemblage of claim 13 wherein $R_1$, $R_2$, $R_3$ and $R_4$ are each phenyl, $R_5$ and $R_6$ are each hydrogen, X is Se and Y is Te or Se.

17. The assemblage of claim 13 wherein $R_1$, $R_2$, $R_3$ and $R_4$ are each tert-butyl, $R_5$ and $R_6$ are each methyl, and X and Y are both Se or both Te.

18. The assemblage of claim 13 wherein said infrared-absorbing material is in said dye layer.

* * * * *